US009649607B2

(12) United States Patent
Matula et al.

(10) Patent No.: US 9,649,607 B2
(45) Date of Patent: May 16, 2017

(54) ARRANGEMENT FOR MIXING A FLUID TO A PROCESS LIQUID AND A METHOD OF OPERATING THE ARRANGEMENT

(71) Applicant: WETEND TECHNOLOGIES OY, Savonlinna (FI)

(72) Inventors: Jouni Matula, Savonlinna (FI); Jussi Matula, Savonlinna (FI)

(73) Assignee: Wetend Technologies Oy, Savonlinna (FI)

( * ) Notice: Subject to any disclaimer, the term of this patent is extended or adjusted under 35 U.S.C. 154(b) by 0 days.

(21) Appl. No.: 14/769,588

(22) PCT Filed: Feb. 21, 2014

(86) PCT No.: PCT/FI2014/050132
§ 371 (c)(1),
(2) Date: Aug. 21, 2015

(87) PCT Pub. No.: WO2014/128355
PCT Pub. Date: Aug. 28, 2014

(65) Prior Publication Data

US 2016/0038897 A1 Feb. 11, 2016

(30) Foreign Application Priority Data

Feb. 22, 2013 (FI) ..... 20135156

(51) Int. Cl.
*B01F 15/02* (2006.01)
*B01F 5/04* (2006.01)
(Continued)

(52) U.S. Cl.
CPC ..... *B01F 15/0243* (2013.01); *B01F 3/0865* (2013.01); *B01F 5/04* (2013.01);
(Continued)

(58) Field of Classification Search
CPC ..... B01F 15/0243
See application file for complete search history.

(56) References Cited

U.S. PATENT DOCUMENTS 1,727,152 A * 9/1929 Winkler ..... B01F 5/162 261/90
1,889,816 A 12/1932 White
(Continued)

FOREIGN PATENT DOCUMENTS

CN 1945098 A 4/2007
CN 102418579 A 4/2012
(Continued)

OTHER PUBLICATIONS

Finnish Office Action, Nov. 20, 2013, seven pages.
(Continued)

*Primary Examiner* — Abbas Rashid
(74) *Attorney, Agent, or Firm* — Nixon & Vanderhye P.C.

(57) ABSTRACT

An arrangement for mixing a fluid to a process liquid by using at least one mixing station and a method of operating the arrangement to feed injection or mixing liquid to injection mixers arranged on a periphery of a flow pipe transferring a process liquid. The arrangement and the method are applicable for the injection of mixers and chemical mixing in processes for the wood processing industry.

12 Claims, 5 Drawing Sheets

(51) Int. Cl.
*B01F 15/04* (2006.01)
*B01F 3/08* (2006.01)

(52) U.S. Cl.
CPC ..... *B01F 5/0405* (2013.01); *B01F 5/048* (2013.01); *B01F 15/0416* (2013.01)

(56) References Cited

U.S. PATENT DOCUMENTS

| | | | | |
|---|---|---|---|---|
| 2,107,390 | A * | 2/1938 | Rosmait | D21D 5/28 366/136 |
| 3,116,912 | A * | 1/1964 | Finsbert | C11D 13/04 210/197 |
| 3,781,320 | A * | 12/1973 | Irwin | B01J 19/1881 366/136 |
| 3,887,167 | A * | 6/1975 | Irwin | B01F 15/0203 366/181.6 |
| 4,664,592 | A * | 5/1987 | Grzina | F04D 29/2266 415/171.1 |
| 6,659,636 | B1 * | 12/2003 | Matula | B01F 3/0865 366/165.1 |
| 7,214,031 | B2 * | 5/2007 | Parrent | B01F 5/0256 415/199.1 |

FOREIGN PATENT DOCUMENTS

| | | | |
|---|---|---|---|
| DE | 28 45 246 | A1 | 4/1980 |
| EP | 0 466 167 | A2 | 1/1992 |
| EP | 1 064 427 | B1 | 3/2004 |
| WO | 2005/032704 | A1 | 4/2005 |
| WO | 2013013717 | A2 | 1/2013 |

OTHER PUBLICATIONS

Sulzer Pumps Finland Oy, Sulzer Pumps MC Discharger brochure [online], published Apr. 30, 2001 [retrieved Nov. 19, 2013]. Internet address: http://www.sulzer.com/fi/Products-and-Services/Pumps-and-Systems/Medium-Consistency-Pumps/MC-Discharger, five pages (Finnish Version).

Sulzer Pumps, MC Discharger, Mar. 2013, four pages, (English Version).

European Search Report mailed Jun. 11, 2014.

English Translation of Chinese Search Report in Chinese Patent Application No. 201480010141.X dated May 26, 2016, 2 pages.

* cited by examiner

ARRANGEMENT FOR MIXING A FLUID TO A PROCESS LIQUID AND A METHOD OF OPERATING THE ARRANGEMENT

CROSS RELATED APPLICATION

This application is the U.S. national phase of International Application No. PCT/FI2014/050132 filed 21 Feb. 2014 which designated the U.S. and claims priority to Finnish Patent Application No. 20135156 filed 22 Feb. 2013, the entire contents of these applications are incorporated by reference.

TECHNICAL FIELD

The present invention relates to an arrangement for mixing a fluid to a process liquid and a method of operating the arrangement. The arrangement and the method of the invention may be used when mixing a fluid to a process liquid by using injection mixers arranged on the periphery of a flow pipe transferring a process liquid. The arrangement and the method of the invention are especially applicable for instance in connection with the mixing of chemical/s in wood processing industry.

BACKGROUND ART

Injection mixers for adding a fluid, i.e. liquid, gas and/or a suspension of liquid and solids, to a process liquid have been known for decades. As an example of modern injection mixers, chemical mixers of Wetend Technologies Oy may be discussed. Patent documents EP-B1-1064427, EP-B1-1219344, FI-B-111868, FI-B-115148 and FI-B-116473 discuss such mixers and explain how injection mixing is used in the introduction and mixing of a fluid into a process liquid. The injection mixing is performed by not only spraying the fluid itself to the process liquid, but an injection liquid is used for enhancing the penetration of the liquid-fluid mixture deep into the process liquid. Sometimes also another liquid, i.e. mixing liquid is used. The injection liquid is not the fluid to be mixed, but another fluid the amount of which is normally higher than that of the fluid to be mixed. The injection liquid may be the same as the process liquid, or it may be some other, though applicable, process liquid, it may be a filtrate from somewhere from the process, or it may be clear water, for instance. The mixing liquid may be yet another liquid, which is normally used for diluting the fluid or chemical to be mixed prior to the introduction of the fluid into communication with the injection liquid. The mixing liquid may, for instance, be chosen from the same list of liquids as the injection liquid. The injection mixing station, is formed of injection mixers arranged on substantially the same circumference of the process pipe or reactor so that one mixer is sufficient for pipes/reactors of small diameter, slightly larger pipes/reactors use two opposing mixers on the same circumference, pipes/reactors slightly larger than this need three mixers located at 120 degree intervals on the circumference and so on. In other words, usually more than one mixer, i.e. a mixing station is needed to inject the fluid to the process liquid in mill scale applications. Sometimes such a mixing station may include another set of injection mixers arranged on another circumference of the flow pipe, however, axially close to the first group of mixers.

The present practice, i.e. the latest and the most advanced way of introducing injection and mixing liquid (if used) to the injection mixers, shown in FIG. 1, has been to arrange the inlet opening of an injection liquid feed pump in communication with a source of appropriate liquid, and to pump the liquid further to a manifold, so called injection liquid manifold, which divides the liquid to the injection mixers. In view of the successful operation of the mixing station it is important that each mixer injects the same amount of fluid/chemical with the same amount of injection liquid. However, the practice has shown that when using manifolds that is not always the case, i.e. the manifolds do not very easily divide the injection liquid equally to the feed lines leading to the injection mixers. In order to ensure that the manifold shares the injection liquid equally enough to the feed lines, a considerable amount of R&D, design, construction and testing work has to be performed for each particular manifold. Further, it has to be understood that the manifold design is highly dependent on the volume flows, whereby a manifold designed for dividing a certain volume flow evenly is not necessarily able to share a volume flow 20% higher or lower evenly enough anymore. Thus it has been learned that the manifold is, in practice, always a compromise between the expenses related to its design, R&D, construction and testing and the equal enough sharing of the injection liquid.

The feed lines from the manifold to the injection mixers are provided with valves but the valves are on-off-type valves and they cannot be used for controlling the volume flow. The main reason for the use of the above type of valves is that the injection liquid is not normally clean liquid but contains particulate matter. This is self-evident as the process liquid itself may very often be used as the injection liquid. If the process liquid is, for instance a paper making stock, it may contain fibers and fillers that would easily, when throttling the flow in a valve, collect or accumulate in places where the flow is slow and less turbulent. After some time the accumulated fibers and/or fillers, more generally accumulated impurities, may loosen and flow along with the flow into the injection mixer. Such accumulated impurities may impede the flow in the injection mixer, block the mixer or at least enter the process liquid and cause problems in the end product or its production. Thus the manifold or a corresponding means for dividing the injection liquid should be capable of dividing the injection liquid evenly to the feed pipes taking the injection liquid to the injection mixers.

If mixing liquid is used, it is common practice to use the liquid used as the injection liquid as the mixing liquid, too, though other liquids may also be used. However, in case it is the injection liquid that is used as the mixing liquid, the through-flow of the injection liquid manifold is usually taken to another manifold, so called mixing liquid manifold that divides the mixing liquid to the injection mixers. The feed lines from the mixing liquid manifold to the injection mixers are provided with valves just like the injection liquid feed lines, too. Exactly the same problems are involved in dividing the mixing liquid to its respective feed pipes as those discussed above in connection with the injection liquid.

BRIEF SUMMARY OF THE INVENTION

An object of the present invention is to develop an arrangement for mixing a fluid to a process liquid and a method of operating the arrangement that overcomes at least some of the above discussed problems.

Another object of the present invention is to develop an arrangement for mixing a fluid to a process liquid and a method of operating the arrangement where the accuracy of the division of the volume flows of the injection liquid is considerably improved.

Yet another object of the present invention is to develop an injection mixing arrangement and a method of operating the arrangement where the expenses relating to the injection liquid feed arrangement have been significantly reduced.

A still further object of the present invention is to develop an arrangement for mixing more than one fluid to a process liquid and a method of operating the arrangement evenly and reliably.

There are a few advantages gained by the use of the present invention, for instance, More even division of the injection liquid Reduced investment costs, and Less space needed around the process piping.

At least one object of the present invention is met with an arrangement for mixing a fluid to a process liquid by means of at least one injection mixing station, the at least one mixing station comprising two or more injection mixers adapted for fastening, when in use, on a periphery of the process liquid flow pipe, each injection mixer having an inlet for the fluid to be mixed and at least one first inlet for an injection liquid used for injecting the fluid out of the injection mixer, the at least one first inlet being connected by means of a feed pipe to a means for dividing liquid, the liquid dividing means, when in use, being arranged in flow communication via a liquid line with a source of liquid, wherein the liquid dividing means is a rotary dividing means having a casing and at least as many outlets as there are injection mixers in the at least one mixing station. At least one object of the present invention is met with a method of operating an arrangement for mixing a fluid to a process liquid, the arrangement comprising at least one injection mixing station, the at least one mixing station comprising two or more injection mixers adapted for fastening, when in use, on a periphery of the process liquid flow pipe, each injection mixer having an inlet for the fluid to be mixed and at least one first inlet for an injection liquid used for injecting the fluid out of the injection mixer, the at least one first inlet being connected by means of a feed pipe to a means for dividing liquid, the liquid dividing means, when in use, being arranged in flow communication via a liquid line with a source of liquid, the method comprising the steps of a) Providing the dividing means with a casing, at least as many outlets as there are injection mixers in the at least one mixing station and a rotor for making up a rotary dividing means, b) Taking a liquid from a liquid source, c) Introducing the liquid to the rotary dividing means, d) Dividing at least a part of the liquid equally to the outlets by means of the rotor, e) Introducing the divided at least a part of the liquid via the feed pipes to the first liquid inlets of the injection mixers, f) Introducing a fluid to the fluid inlets of the injection mixers, and g) Injecting and mixing the fluid by means of the liquid into the process liquid.

Other characteristic features of the arrangement and the method of the present invention are disclosed in the appended patent claims.

BRIEF DESCRIPTION OF DRAWING

In the following, the arrangement and the method of the present invention are discussed in more detail with reference to the appended figures, in which.

DETAILED DESCRIPTION OF DRAWINGS

Figure 1:
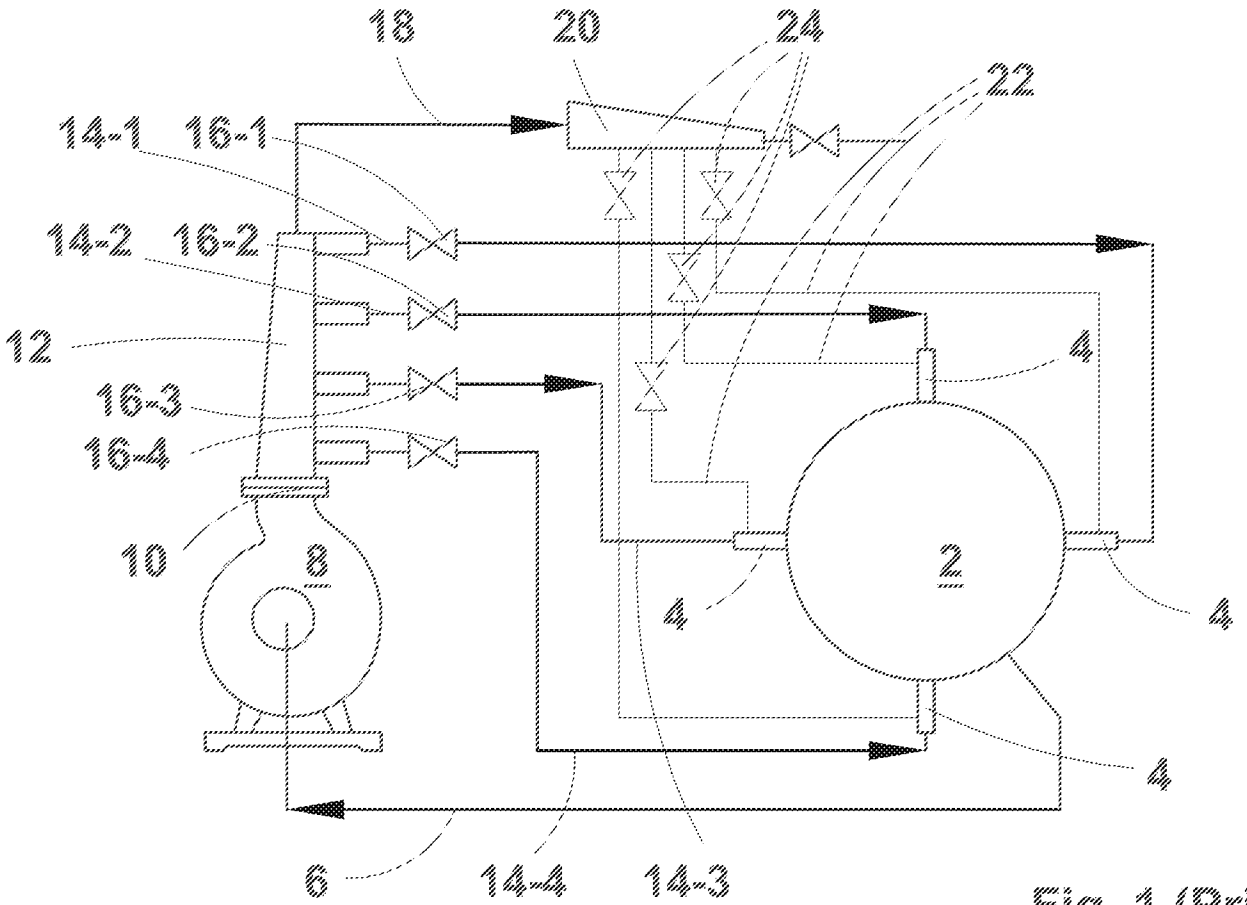
Fig. 1 (Prior art)
FIG. 1 illustrates schematically a prior art injection mixing arrangement.

FIG. 1 show the latest and the most advanced prior art way of introducing injection and mixing liquid (if used) to the injection mixers. FIG. 1 shows a process liquid flow pipe 2 having an injection mixing station, i.e. four injection mixers 4 arranged at equal spacing (90 degrees) on its circumference. As already mentioned above the number of injection mixers 4 depends mainly on the diameter of the flow pipe, the number varying from 1 to about 7. Here, the process liquid flow pipe 2 is provided with a line 6 introducing injection liquid from the process liquid flow pipe 2 to a feed pump 8, which is arranged for feeding injection liquid to the injection mixers 4. The feed pump 8 has a pressure outlet 10, which is arranged in flow communication with a manifold 12, so called injection liquid manifold. The manifold 12 divides the injection liquid flow to four feed lines 14-1, 14-2, 14-3 and 14-4, which terminate to the first liquid inlets of the injection mixers 4. (See the injection mixer in more detail in FIG. 2) The feed lines 14-1, 14-2, 14-3 and 14-4 are provided with valves 16-1, 16-2, 16-3 and 16-4, which are, in practice, on-off valves as they cannot be used for controlling the volume flow. This is the case mainly due to the impurities (for instance fibers) in the injection liquid, as throttling the flow in a valve may cause the impurities to collect or accumulate in places where the flow is slow or less turbulent. The accumulated impurities may loosen and flow along with the flow into the injection mixer. Such accumulated impurities may impede the flow in the injection mixer, block the mixer or at least enter the process liquid and cause problems in the end product or its production.

FIG. 1 also shows, as an additional and optional feature of a prior art injection feeding arrangement the way the mixing liquid is introduced to the injection mixers. In this optional arrangement the mixing liquid is taken from an additional outlet (here at the end) of the injection liquid manifold 12 as a through-flow. The mixing liquid is taken via line 18 to a mixing liquid manifold 20, which divides the mixing liquid to feed lines 22 for introducing the mixing liquid to the second liquid inlet of each injection mixer 4. The feed lines 22 are provided with valves 24, which are similar to the valves 16-1, 16-2, 16-3 and 16-4 in the injection liquid feed lines 14-1, 14-2, 14-3 and 14-4. When using manifolds for dividing a liquid to several outlets it is common practice that the inlet flow (in line 18) of the manifold 20 is greater than the sum of the outlet flows to the feed lines 22, whereby a flow is taken through the mixing liquid manifold 20 as shown by an outlet and a valve at an end opposite the inlet line 18. The valve being, in fact, used for controlling the flow to the outlet lines 22.

Figure 2:
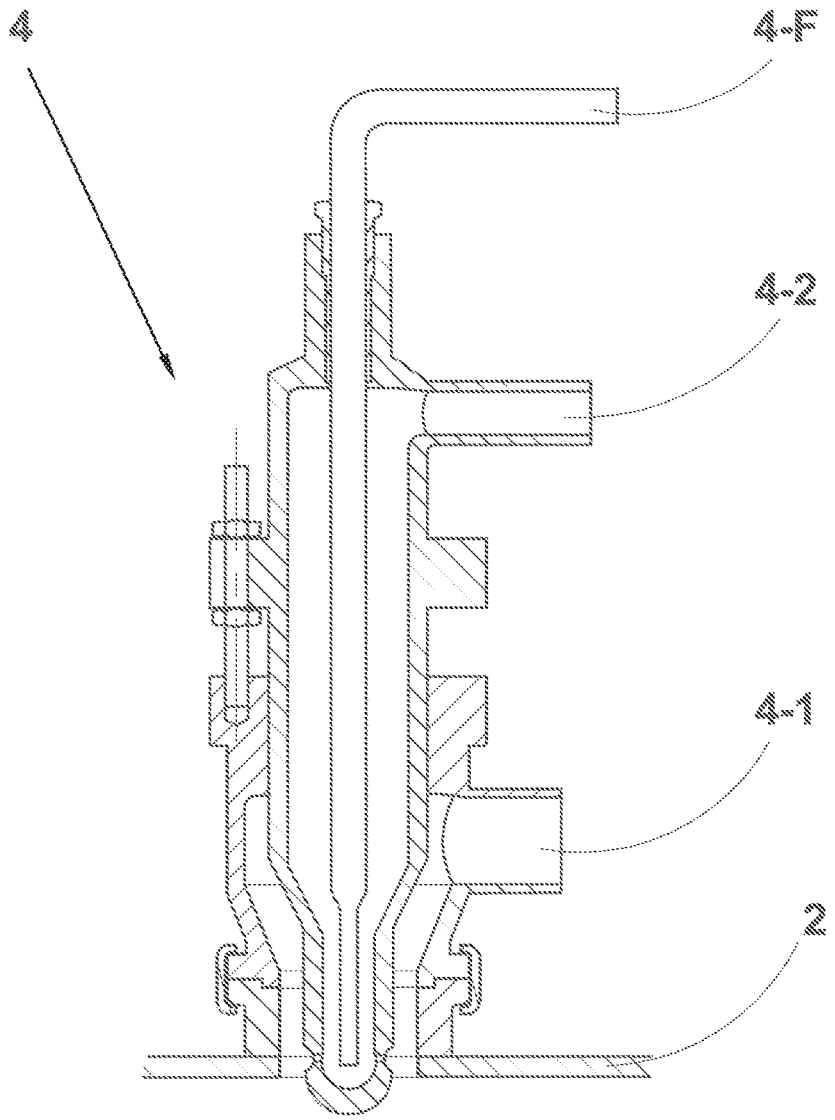
Fig. 2 (Prior art)
FIG. 2 illustrates schematically a prior art injection mixer.

FIG. 2 illustrates an exemplary prior art injection mixer or nozzle 4. The injection mixer 4 comprises a casing, the structure of which is not discussed here in any more detail, as it has a number of variations that may all be used in connection with the arrangement of the present invention.

The injection mixer 4 is adapted for fastening, when in use, to a process liquid flow pipe 2. The injection mixer 4 and, to be more specific its casing, is provided with a fluid inlet 4-F for receiving a fluid, i.e. chemical or additive or any other liquid, gas and/or a suspension of liquid and solids, that is to be injected out of the injection mixer 4 into the process liquid flowing in the process liquid flow pipe, into the injection mixer 4 and a first inlet 4-1 for a first liquid, so called injection liquid. The injection mixer 4 may be, but is not necessarily, provided with a second inlet 4-2 for a second liquid, so called mixing liquid. The injection mixer functions such that the fluid or chemical introduced into the injection mixer and the injection liquid are injected in the process liquid at a high speed whereby the chemical spreads evenly deep into the process liquid flow. If mixing liquid is used, the chemical may be first mixed or diluted with the mixing liquid, if such is considered necessary, whereafter the mixture thereof is injected into the process liquid by means of the injection liquid. However, the contact of the chemical and the mixing liquid may take place simultaneously with their injection to the process liquid. Also, it is possible to use the injection mixer for injecting more than one chemical or additive to the process liquid.

Figure 3:
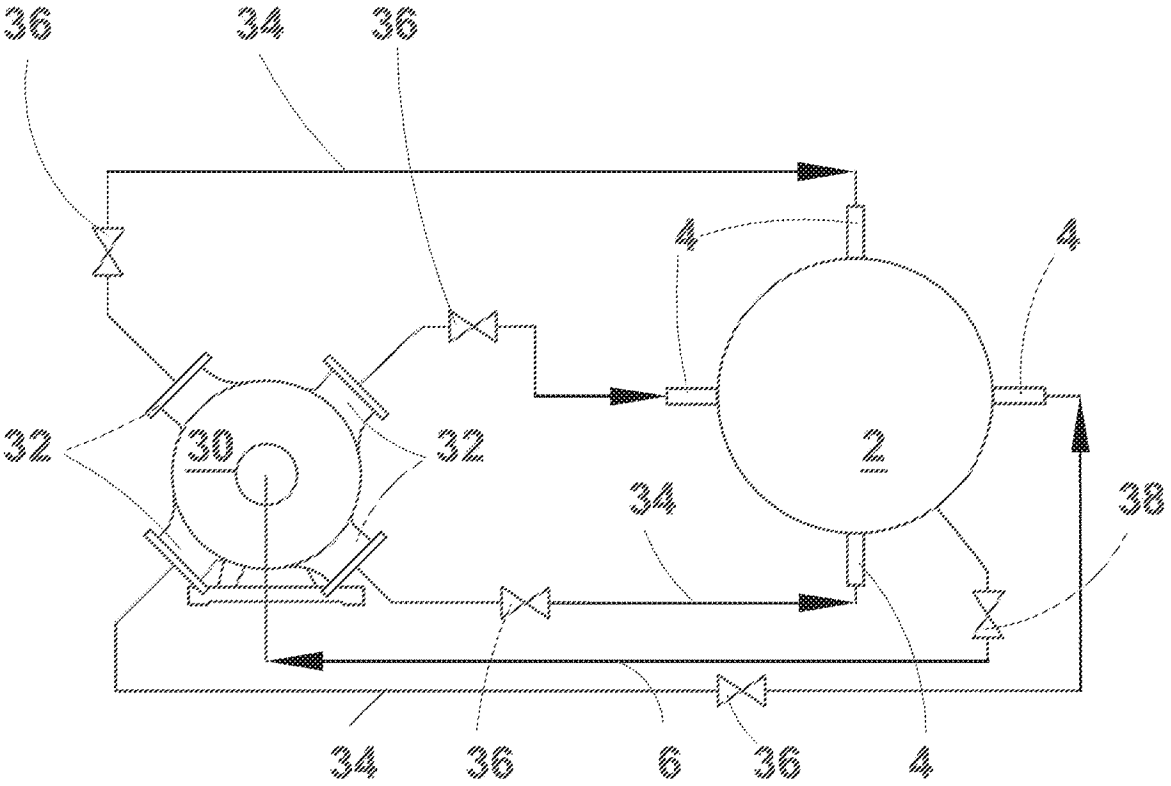
FIG. 3 illustrates schematically an injection mixing arrangement in accordance with a first preferred embodiment of the present invention.

FIG. 3 illustrates a first preferred embodiment of the present invention. The injection liquid is taken, in this embodiment, via line 6 from the process liquid flow pipe 2. The injection liquid may, however, be any appropriate liquid that is taken from the process itself, from another process or from a source of fresh liquid, just to name a few alternatives without any intention to limit the injection liquid that may be used in the present invention. Thus any appropriate injection liquid irrespective of its origin is taken to a rotary means 30 for dividing the injection liquid; the rotary dividing means 30 having a casing provided with a rotor and at least as many outlets 32 as there are injection mixers 4 in the mixing station on the periphery of the process liquid flow pipe 2. The outlets 32 are preferably, but not necessarily, arranged symmetrically to the casing of the rotary dividing means 30. The means 30 divides the injection liquid evenly to the outlets 32 and to the feed lines 34 arranged in communication therewith. The feed lines 34 are provided with valves 36 that are used in a similar manner as the on-off valves in the prior art FIG. 1. The feed lines 34 take the injection liquid to the first, i.e. the injection liquid inlet (inlet 4-1 in FIG. 2) of the injection mixer 4. The line 6 taking injection liquid from its source (here the process liquid flow pipe has been shown as a preferred but not necessary exemplary source) is provided with a valve 38 that may be used to control the amount of injection liquid entering the injection arrangement of the present invention. Another means for controlling the flow of injection liquid is a flow meter in line 6 connected to an inverter controlled rotary dividing means 30, whereby the flow in line 6 may be easily maintained at a desired level by controlling the rotational speed of the rotary dividing means. Preferably, the above discussed rotary dividing means 30 is a device working as and resembling a centrifugal pump having an impeller (the rotor) and at least as many pressure outlets as there are injection mixers 4 in the mixing station, i.e. on the periphery of the process liquid flow pipe 2. The rotary dividing means is designed and constructed such that the fluid pressure in the casing is equal, whereby the volume flows from the pressure outlets are always equal. This means, in practice that the outlets in the casing may be arranged either symmetrically or non-symmetrically. The latter option is a preferred one if the formation of pressure pulses is considered a risk. In other words, the volume flows of the injection liquid to the injection mixers may be adjusted steplessly just by changing the rotational speed of the impeller of the centrifugal pump or by controlling the volume flow to the pump by means of the valve 38 in line 6. However, the rotary dividing means may also be an axial device having a casing with symmetrically or non-symmetrically arranged more or less axial outlets arranged round the axis of the casing. The casing is in such a case provided with a rotor that creates turbulence sufficient for preventing the injection liquid from settling in the casing and for dividing the injection liquid evenly to the outlets.

Figure 4:
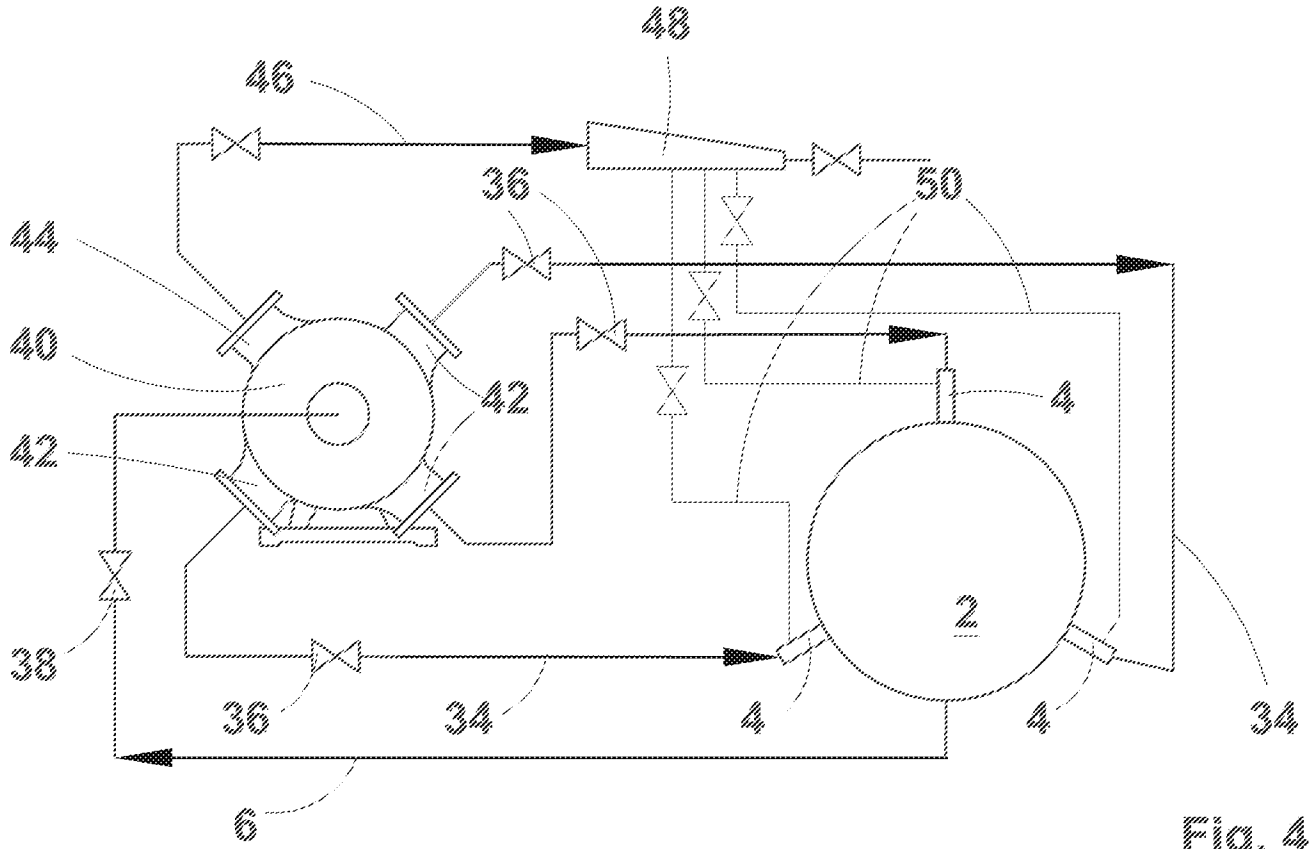
FIG. 4 illustrates schematically an injection mixing arrangement in accordance with a second preferred embodiment of the present invention.

FIG. 4 illustrates a second preferred embodiment of the present invention. The injection liquid is taken, in this embodiment, via line 6 and valve 38 (or flow meter) from the process liquid flow pipe 2 without, however, any intention to limit the injection and/or mixing liquid that may be used in the present invention. Thus any appropriate injection liquid irrespective of its origin may be taken to a rotary dividing means 40, which is provided with outlets 42 and an outlet 44. The number of outlets 42 is equal with, or higher than, the number of injection mixers 4 of the mixing station (i.e. here three injection mixers at 120 degrees intervals) arranged on the periphery of the process liquid flow pipe 2. The outlets 42 are preferably, but not necessarily (see the discussion in connection with FIG. 3), arranged symmetrically to the casing of the rotary dividing means, whereby the rotary dividing means 40 divides the injection liquid evenly to the outlets 42 and to the feed lines 34 arranged in communication therewith. The feed lines 34 are provided with valves 36 that are used in a similar manner as the on-off valves in the prior art FIG. 1. The feed lines 34 introduce the injection liquid to the first inlets of the injection mixers 4.

Now, the rotary dividing means 40 is provided with at least one other outlet 44, which is connected by means of a feed line 46 to a dividing means 48 for dividing the mixing liquid equally to feed lines 50. In FIG. 4, the dividing means is illustrated as a manifold 48 for introducing mixing liquid to the injection mixers 4. However, another rotary dividing means, similar (but possibly different in size) to the one referred to by reference numeral 40 may be used as the dividing means 48. In other words, now the injection liquid and the mixing liquid are the one and the same liquid. The dividing means, i.e. the manifold 48 or the rotary dividing means divides the mixing liquid to feed lines 50, which take the mixing liquid to the second inlets, i.e. the mixing liquid inlets (inlet 4-2 in FIG. 2) of the injection mixers 4.

Just like in the embodiment of FIG. 3, the above discussed rotary dividing means 40 is preferably a device working as and resembling a centrifugal pump having an impeller/rotor and at least one pressure outlet for each injection mixer 4 in the mixing station, i.e. on the periphery of the process liquid flow pipe 2 plus at least one pressure outlet for the mixing liquid. The rotary dividing means 40 is designed and constructed such that the volume flows from the pressure outlets are always equal. In other words, the volume flows of the injection liquid to the injection mixers may be adjusted steplessly just by changing the rotational speed of the centrifugal pump or by controlling the volume flow to the pump by means of the valve 38 in line 6. In the present embodiment the volume flow of the mixing liquid is equal to the volume flow of the injection liquid introduced to each injection mixer 4, provided that the counter pressure in line 46 is the same as that in lines 34. However, that is normally not the case but the counter pressure in lines 34 is higher. This means, in practice, that the volume flow of the mixing liquid, which could be divided by the mixing liquid manifold 48 substantially evenly to each injection mixer, is higher than one third of the volume flow of the injection liquid to each injection mixer. The actual amount of the mixing liquid may be controlled by a throttle valve in line 46 or by allowing some mixing liquid flow through the mixing liquid manifold 48 as shown by an outlet and a valve in FIG. 4.

Figure 5:
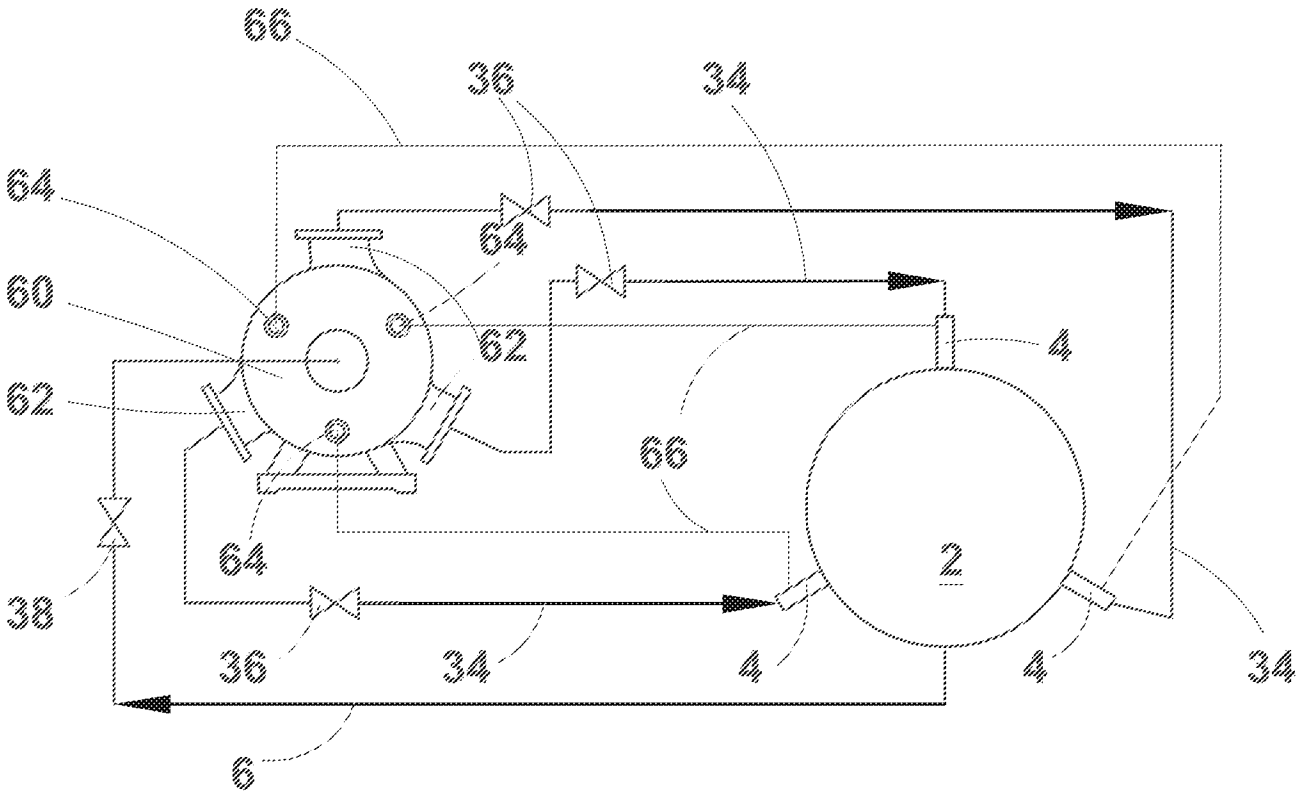
FIG. 5 illustrates schematically an injection mixing arrangement in accordance with a third preferred embodiment of the present invention.

FIG. 5 illustrates a third preferred embodiment of the present invention. The injection liquid is taken, in the manner of the earlier embodiments, via line 6 and valve 38, or flow meter, from the process liquid flow pipe 2 without, however, any intention to limit the injection and/or mixing liquid that may be used in the present invention. Thus any appropriate injection liquid irrespective of its origin is taken to a rotary dividing means 60, which is provided with a first set of outlets 62. The number of outlets 62 is equal with, or higher than, the number of injection mixers 4 of a mixing station arranged on the periphery of the process liquid flow pipe 2. The outlets 62 are arranged symmetrically or non-symmetrically to the casing of the rotary dividing means. The rotary dividing means 60 divides the injection liquid evenly to the outlets 62 and to the feed lines 34 arranged in communication therewith and taking the injection liquid to the first inlets of the injection mixers 4. The feed lines 34 are provided with valves 36 that are used in a similar manner as the on-off valves in the prior art FIG. 1. This far the embodiment of FIG. 5 does not differ at all from the earlier embodiments. However, in this embodiment the rotary dividing means 60 has further in its casing a second set of outlets 64, which are also arranged preferably, but not necessarily, symmetrically to the casing of the rotary dividing means 60. The number of the second outlets 64 equals to, or is higher than, the number of injection mixers of the mixing station. The second outlets 64 introduce the mixing liquid to feed lines 66, which take the mixing liquid to second, i.e. mixing liquid inlets of the injection mixers 4. In this embodiment the volume flow of the mixing liquid is not dependent on the volume flow of the injection liquid in the same manner as in the embodiment of FIG. 4. The volume flows are proportional, but the basic setting of the volume flows may be predetermined by the design and location of the respective outlets. In accordance with a further preferred embodiment of the present invention the pressure outlets for the injection liquid are in relation to each other symmetrically positioned at the casing of the rotary dividing means, and, in a similar manner, the pressure outlets for the mixing liquid are in relation to each other symmetrically positioned at the casing of the rotary dividing means. In other words, the pressure outlets 62 for the injection liquid are divided round the casing at an interval of 360/N degrees, where N is number of injection mixers 4. And in a similar manner the pressure outlets 64 for the mixing liquid are divided round the casing at an interval of 360/N degrees, where N is number of injection mixers 4. The location of the outlets 62 for the injection liquid in the casing of the rotary dividing means are, in this embodiment, the same, i.e. the outlets are similarly designed and positioned. The same applies to the outlets 64 for the mixing liquid. Thus, the outlets may be tangential, radial, axial or any combination of these, as long as they are the same within each set of outlets.

Just like in the embodiment of FIGS. 3 and 4, the above discussed rotary dividing means 60 is preferably a device working as and resembling a centrifugal pump having at least one pressure outlet for each injection mixer 4 in the mixing station, i.e. on the periphery of the process liquid flow pipe 2 plus at least one pressure outlet for the mixing liquid for each injection mixer 4. The rotary dividing means 60 is designed and constructed such that the volume flows from the pressure outlets are always equal. In other words, the volume flows of the injection liquid to the injection mixers may be adjusted steplessly just by changing the rotational speed of the centrifugal pump or by controlling the volume flow of the injection liquid to the pump by means of the valve 38 in line 6.

One way of designing the casing of the rotary dividing means is to provide the casing with a round cross section and drill substantially radial holes for the pressure outlets. The casing may be provided originally with a certain number of (for instance 4) holes for the outlets and then reserve in between the already drilled holes space for (for instance 3) additional holes. Thus the 4 original holes may be at 90 degrees intervals, i.e. symmetrically, whereby drilling of one additional hole between any two holes results in non-symmetrical arrangement for the holes, or, for example, the 4 original holes may be drilled at an interval of 70 degrees, whereby the remaining 3 holes have a sector of 150 degrees to fit into, whereby the positioning of the holes and outlets is always non-symmetrical. Naturally any other imaginable division of holes may be applied here, too.

In a further preferred, but not illustrated, embodiment of the present invention the injection mixing station is provided with one rotary dividing means for the injection liquid and another rotary dividing means for the mixing liquid. This kind of an arrangement brings about a number of advantages. Firstly, the volume flows of the injection liquid and mixing liquid are not any more proportional but may be freely adjusted, i.e. both rotary dividing means may have their own flow meters and inverter controlled drive motors. Secondly, though the mixing liquid and injection liquid may be taken from the same source, i.e. the rotary dividing means may be coupled in parallel between line 6 introducing the injection and mixing liquids to the rotary dividing means and the injection mixers 4, it is also possible to use a mixing liquid different from the injection liquid. For instance, it is possible to use paper making stock or non-clarified filtrate as the injection liquid and clear filtrate or fresh water as the mixing liquid, just to name a few exemplary options without any intention to limit the invention to those examples.

A further feature of the present invention that has to be taken into account when taking the rotary dividing means in use is that, in most applications, it is of utmost importance that the rotary dividing means may not introduce pulsating flows to the injection mixers. The reason for the above requirement is the positioning of the mixing station very close to the headbox of the fiber web machine, as if the injection mixers receive pulsating flows, they also inject pulsating jets to the stock, and the stock takes the pulses through the headbox to the wire of the fiber web machine. The pulses in the headbox flow causes changes in the uniformity of the slice flow, resulting in local changes in the grammage of the web and overall reduction in the quality of the end product.

The pulsating of the rotary dividing means may be prevented by two optional ways. The first option is to arrange the outlet openings to be used in the casing of the rotary dividing means non-symmetrically, for instance, by arranging seven outlets in 360/7 degrees intervals and using only three, four or five of them for introducing liquid to the injection mixer. Another option is to arrange the number of vanes of the impeller/rotor differ substantially from the number of outlet openings. In other words, the number of vanes may neither be a multitude of the number of outlet openings, nor a half of that. This means in practice, for instance, that when the rotary dividing means have 6 symmetrical outlets for injection liquid, the rotor/impeller may not have 6 vanes, which are by nature symmetrically arranged, but the preferable number of vanes would be 5 or 7. In a similar manner, if the number of vanes is 5, the number of outlets for injection liquid should be 4, 6, 7 or 8, for instance. In other words, $N_v < > Z*N_o$ or $N_o < > Z*N_v$, where $N_v$ is the number of rotor vanes, $N_o$ is the number of outlets in the rotary dividing means, and Z is an integer, i.e. one of 1, 2, 3, 4, 5, etc. The above setting of outlets applies individually for both set of outlets for the injection liquid and set of outlets for the mixing liquid, and also for the combined number thereof, if the outlets have been arranged symmetrically one after another on the periphery of the rotary dividing means.

It should be understood that the above is only an exemplary description of a novel and inventive an arrangement for feeding liquid to at least one mixing station. It should be understood that the above description discusses only a few preferred embodiments of the present invention without any purpose to limit the invention to the discussed embodiments and their details only. Thus the above specification should not be understood as limiting the invention by any means but the entire scope of the invention is defined by the appended claims only. From the above description it should be understood that separate features of different embodiments of the invention may be used in connection with other separate features of other embodiments even if such a combination has not been specifically discussed in the description or shown in the drawings.

The invention claimed is:

1. A mixing arrangement for mixing a fluid to a process liquid comprising:

a mixing station for a process liquid flow pipe, wherein the mixing station includes injection mixers distributed about and attached to the process liquid flow pipe, wherein each of the injection mixers includes an inlet configured for the fluid to be mixed with the process liquid flowing through the process liquid flow pipe and a first inlet configured for an injection liquid to inject the fluid from the injection mixer into the process liquid flow pipe;

the first inlets are each connectable, via a respective feed pipe, to an injection liquid distributor configured to distribute the injection liquid to the injection mixers;

the injection liquid distributor includes a centrifugal pump, a pump casing and an inlet to the casing connected via an injection liquid line to the process liquid flow pipe, and outlets on the pump casing wherein a plurality of the outlets are each connected via a respective one of the feed pipes to the first inlet of a corresponding one of the injection mixers.

2. The mixing arrangement as recited in claim 1, wherein the fluid includes mixing liquid which dilutes a chemical in the injection liquid or adds a chemical to the injection liquid, wherein the inlet of each of the injection mixers is in flow communication with one of the outlets on the pump casing.

3. The mixing arrangement as recited in claim 2, further comprising a mixing liquid outlet on the pump casing.

4. The mixing arrangement as recited in claim 1, wherein the fluid includes a mixing liquid which dilutes a chemical in the injection liquid or adds a chemical to the injection liquid, and the inlet of each injection mixer is configured to be in flow communication with another liquid distributor.

5. The mixing arrangement as recited in claim 4, wherein the another liquid distributor is one of another centrifugal pump and a manifold.

6. The mixing arrangement as recited in claim 5, further comprising mixing liquid outlets on the pump casing, wherein each of the mixing liquid outlets on the pump casing is in flow communication with one of the injection mixers.

7. The mixing arrangement as recited in claim 6, wherein the mixing liquid outlets on the pump casing are symmetrically arranged on the pump casing.

8. The mixing arrangement as recited in claim 5, wherein the another liquid distributor is connected to a source of the mixing liquid, and the source is other than the process liquid flowing through the process liquid flow pipe.

9. The mixing arrangement as recited in claim 1, wherein the outlets on the pump casing have flow passages that are substantially equal in cross sectional area.

10. The mixing arrangement as recited in claim 1, wherein the centrifugal pump includes a rotor having symmetrically arranged vanes, and the rotor vanes and the outlets on the pump casing are in number each defined by one of the equations:

Nv is greater or less than the product of Z and No, and No is greater or less than the product of Z and Nv, where $N_v$ is the number of rotor vanes, $N_o$ is the number of the outlets on the pump casing, and Z is any positive integer.

11. The mixing arrangement as recited in claim 1, wherein either the centrifugal pump includes a rotor having symmetrically arranged vanes, whereby the number of vanes multiplied or divided by any positive integer is unequal to the number of the outlets on the pump casing, or the outlets on the pump casing are asymmetrically arranged on the pump casing.

12. A mixing arrangement for mixing a fluid to a process liquid comprising:

a mixing station at a process liquid flow pipe, wherein the mixing station includes injection mixers each fastened to the process liquid flow pipe and each injection mixer includes first and second inlets and an outlet, wherein the outlet is open through the process liquid flow pipe to a process liquid flow passage in the process liquid flow pipe, the first inlet is configured to receive an injection liquid, and the second inlet configured to receive a fluid to be mixed with process liquid, and feed pipes wherein the first inlet of each injection mixer is connected to a corresponding one of the feed pipes;

an injection liquid distributor including a centrifugal pump having a pump casing with outlets on the pump casing, wherein each of the outlets on the pump casing is connected to a corresponding one of the feed pipes, and an injection liquid line extending from the process liquid flow pipe to an inlet of the injection liquid distributor, wherein the injection liquid line is configured to convey liquid from the process liquid flow pipe to the injection liquid distributor.

* * * * *